US008274435B2

(12) United States Patent
Maruyama

(10) Patent No.: US 8,274,435 B2
(45) Date of Patent: Sep. 25, 2012

(54) ANTENNA APPARATUS

(75) Inventor: Akihiro Maruyama, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 455 days.

(21) Appl. No.: 12/592,407

(22) Filed: Nov. 24, 2009

(65) Prior Publication Data

US 2010/0127948 A1 May 27, 2010

(30) Foreign Application Priority Data

Nov. 25, 2008 (JP) ..... 2008-300046

(51) Int. Cl.
*H01Q 1/24* (2006.01)

(52) U.S. Cl. ..... 343/702; 343/700 MS; 343/895

(58) Field of Classification Search ..... 343/702, 343/700 MS, 895, 846, 858
See application file for complete search history.

(56) References Cited

U.S. PATENT DOCUMENTS

| | | | | |
|---|---|---|---|---|
| 6,239,753 | B1 * | 5/2001 | Kado et al. | 343/702 |
| 2005/0078038 | A1 * | 4/2005 | Takaki et al. | 343/702 |
| 2005/0190109 | A1 * | 9/2005 | Washiro | 343/702 |

FOREIGN PATENT DOCUMENTS

| | | |
|---|---|---|
| JP | 2004-056559 | 2/2004 |
| JP | 2008-118273 | 5/2008 |

* cited by examiner

*Primary Examiner* — Hoanganh Le

(57) ABSTRACT

A portable terminal includes a small-sized built-in antenna apparatus having an excellent electric performance. The built-in antenna apparatus includes a ground plate and an antenna unit. The ground plate includes a feed point. The antenna unit is disposed adjacent to an end of the ground plate. The antenna unit includes a reverse L-shaped antenna element. One end of the L-shaped antenna element is connected to the feed point and an opposite end of the L-shaped antenna has a helical shape. A magnetic piece is loaded at a portion where current distribution of the L-shaped antenna element is high, and a dielectric piece is loaded at a portion where current distribution of the L-shaped antenna element is low.

20 Claims, 12 Drawing Sheets

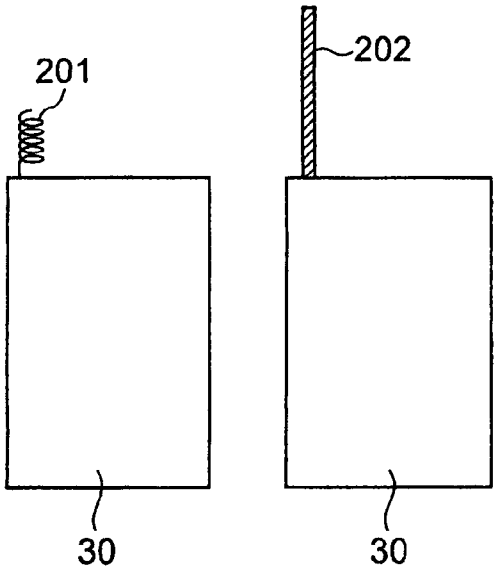
FIG.2A
FIG.2B
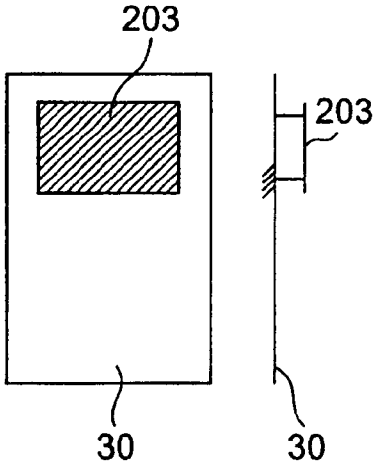
FIG.2C
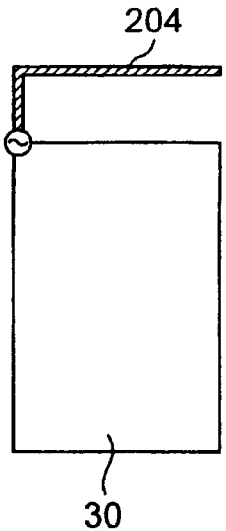
FIG.2D
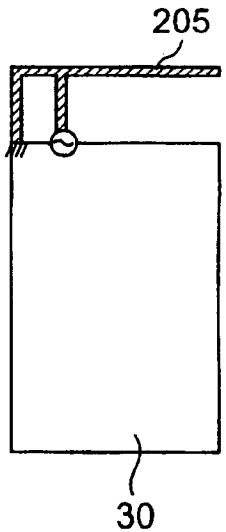
FIG.2E

| Name | Freq | Ang | Mag | RX |
|---|---|---|---|---|
| m1 | 0.8250 | -153.0814 | 0.6669 | 0.2108-0.2292i |
| m2 | 0.8900 | 137.1011 | 0.6045 | 0.2819+0.3656i |
| m3 | 0.9600 | 85.6403 | 0.6803 | 0.3952+0.9980i |

| Name | X | Y |
|---|---|---|
| m1 | 0.8240 | 5.0047 |
| m2 | 0.8900 | 4.0572 |
| m3 | 0.9600 | 5.2554 |

| Name | Freq | Ang | Mag | RX |
|---|---|---|---|---|
| m1 | 0.8250 | 22.0853 | 0.7082 | 2.6363+2.8167i |
| m2 | 0.8900 | 173.2862 | 0.1246 | 0.7795+0.0231i |
| m3 | 0.9600 | 109.1763 | 0.6733 | 0.2884+0.6709i |

| Name | X | Y |
|---|---|---|
| m1 | 0.8240 | 5.8542 |
| m2 | 0.8900 | 1.2846 |
| m3 | 0.9600 | 5.1219 |

ANTENNA APPARATUS

CROSS-REFERENCE TO RELATED APPLICATION(S) AND CLAIM OF PRIORITY

The present application is related to and claims the priority under 35 U.S.C. §119(a) of an application entitled "Antenna Apparatus" filed in the Japanese Patent Office on Nov. 25, 2008 and assigned Serial No. JP 2008-300046, the contents of which are hereby incorporated by reference.

TECHNICAL FIELD OF THE INVENTION

The present invention relates to an antenna apparatus, and more particularly to a single band built-in antenna apparatus for use in a wireless device in mobile communication.

BACKGROUND OF THE INVENTION

Conventional antennas mounted to portable terminals are classified into a first type antenna which is mounted to the outside of a portable terminal, a second type antenna which is mounted on a printed wiring board (PWB) within a portable terminal, and a third type antenna which is mounted to an upper portion of a lengthwise section of a PWB within a portable terminal.

An example of the first type antenna is a dual band antenna disclosed in Japanese Patent Laid-Open No. 2004-56559. The first type antenna mounted to outside of a terminal has high-performance electric characteristics which are readily adjusted. An example of the second type antenna is a multi-band adaptive antenna apparatus disclosed in Japanese Patent Laid-Open No. 2008-118273. The second type antenna may be advantageously embedded in a terminal. The third type antenna may be advantageously made smaller than the second type antenna.

FIGS. 2A to 2E schematically illustrate the first to third type antennas. FIGS. 2A to 2B illustrate examples of the first type, FIG. 2C illustrates an example of the second type, and FIGS. 2D and 2E illustrate examples of the third type.

The three types of antennas have the above-discussed advantages, but have the following problems.

The first type antenna requires a large mounting volume outside a terminal. Therefore, in recent years when terminals tend to be made smaller, this type is difficult to use due to restriction on its design. The second type antenna mounted on a PWB has a large size, causing a problem in realizing a small-sized antenna. Therefore, the second type antenna cannot be used for a small-sized antenna. The third type antenna includes the electric characteristics that deteriorate due to a low impedance generated when it is made smaller or an increase in capacitive coupling.

SUMMARY OF THE INVENTION

To address the above-discussed deficiencies of the prior art, it is a primary object to provide a built-in antenna apparatus for a portable terminal that can be made small-sized and realize an excellent electric performance.

In accordance with an aspect of the present invention, there is provided a built-in antenna apparatus for a portable terminal including: a ground plate including a feed point; and an antenna unit disposed adjacent to an end of the ground plate and including a reverse L-shaped antenna element, one end of which is connected to the feed point and an opposite end of which comprises a helical shape, a magnetic piece loaded at a portion where current distribution of the antenna element is high, and a dielectric piece loaded at a portion where current distribution of the antenna element is low. Accordingly, the antenna apparatus according to the present invention can realize both small size and excellent electric performance.

In the antenna apparatus, the helical shape of the antenna element is formed by the opposite end of the antenna element on a surface of the dielectric piece. Further, in the antenna apparatus, a long edge of the reverse L-shape of the antenna element is parallel to an end of the ground plate and an impedance is adjusted by varying the distance between the long edge of the reverse L-shape of the antenna element and the end of the ground plate. As a result, the antenna apparatus of the invention can achieve desired characteristics.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIGS. 2A to 2E illustrate conventional antennas;

DETAILED DESCRIPTION OF THE INVENTION

FIGS. 1A through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communications terminal.

Figure 1A:
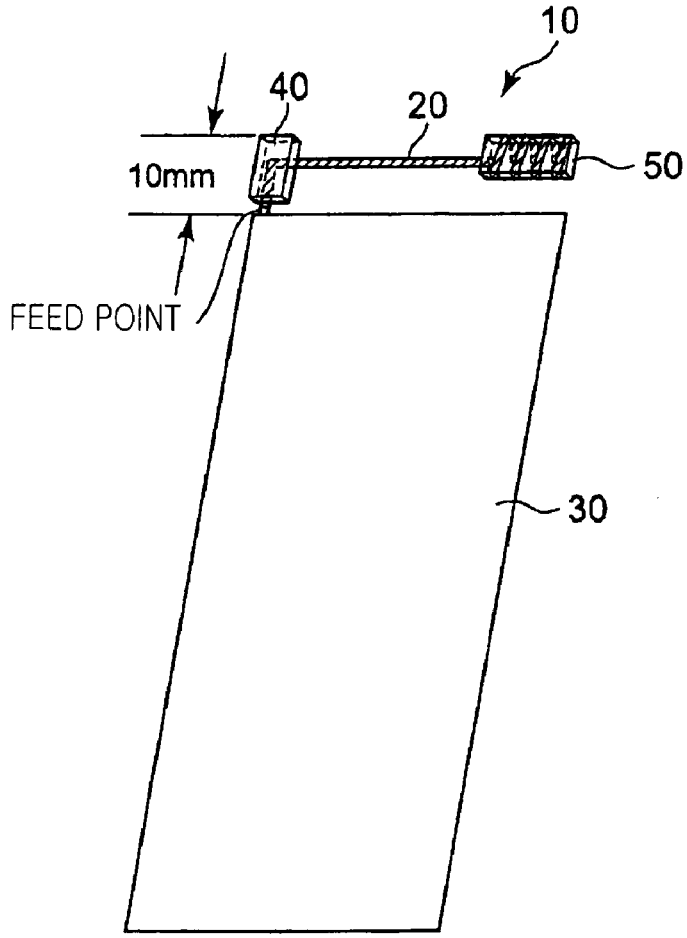
FIG. 1A is an overall view of an antenna apparatus according to embodiments of the present invention.
Figure 1B:
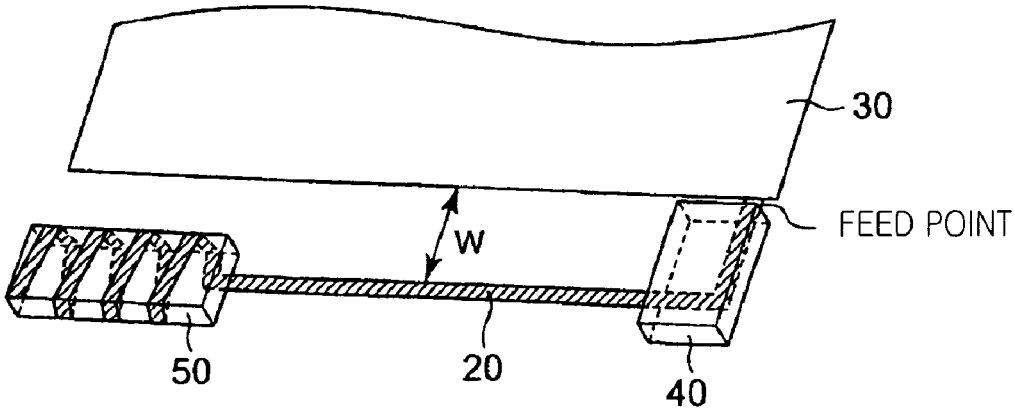
FIG. 1B is an enlarged view of the antenna section of FIG. 1A.

FIGS. 1A and 1B illustrate an antenna apparatus according to an embodiment of the present invention. FIG. 1A illustrates the entire antenna apparatus, and FIG. 1B illustrates an enlarged portion of the antenna apparatus. In the antenna apparatus 10, in order to make the antenna apparatus 10 small-sized, a planar helical shape is formed at a tip end of an reverse L-shaped antenna element 20, which is formed on surfaces of a magnetic piece 40 and a dielectric piece 50. A feed point is installed and mounted at a relatively short end of a ground plate 30. Here, the magnetic piece 40 is disposed near a source of the antenna element 20, that is, near the feed point. The dielectric piece 50 is located at a tip end of the antenna element 20.

In the embodiment of FIG. 1, the ground plate 30 is dimensioned to be 100 mm by 45 mm. The size of the ground plate 30 corresponds to the size of a PWB of a general portable terminal. The mounting size of an antenna unit (here, an antenna device 20, a magnetic piece 40, and a dielectric piece 50 will be referred to as an antenna unit) that includes an antenna device 20, a magnetic piece 40, and a dielectric piece 50 is 10 mm from an end of the ground plate 30. This structure prevents a portable terminal in which the antenna unit and the ground plate 30 are embedded from being larger in size. For example, the width of the antenna element 20 is dimensioned to be 1 mm.

The distance between the ground plate 30 and the linear elongated portion of the antenna element 20 is associated with adjustment of antenna impedance and may be arbitrarily designed. The interval and number of helical teeth of the tip end of the antenna element 20 is associated with a resonance frequency and may be arbitrarily designed. The magnetic piece 40 may be formed of ferrite and the dielectric piece 50 may be formed of ceramic. The magnetic piece 40 and the dielectric piece 50 will be described below.

Figure 3A:
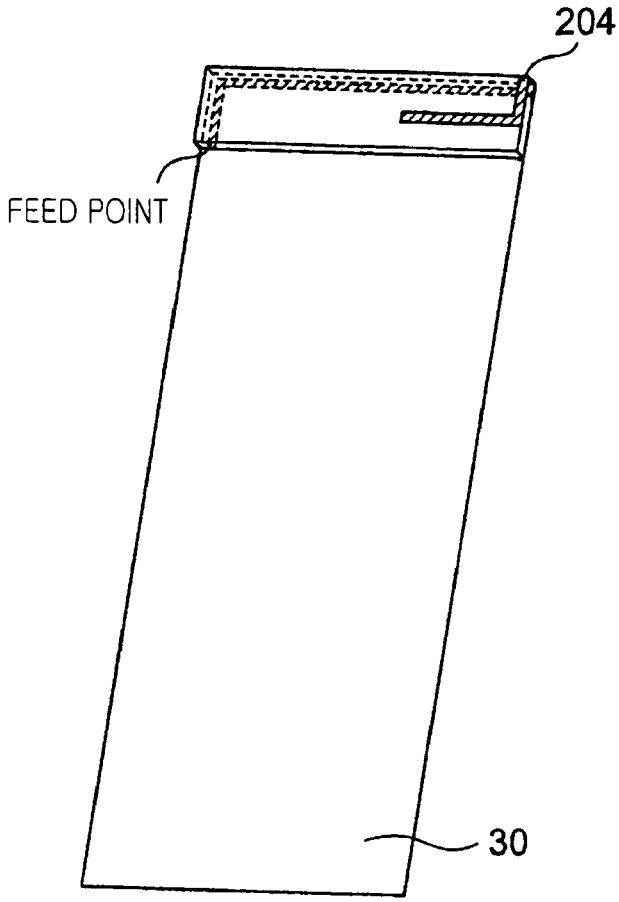
FIG. 3A illustrates a reverse L-shaped antenna apparatus using simulation of an electric performance.
Figure 3B:
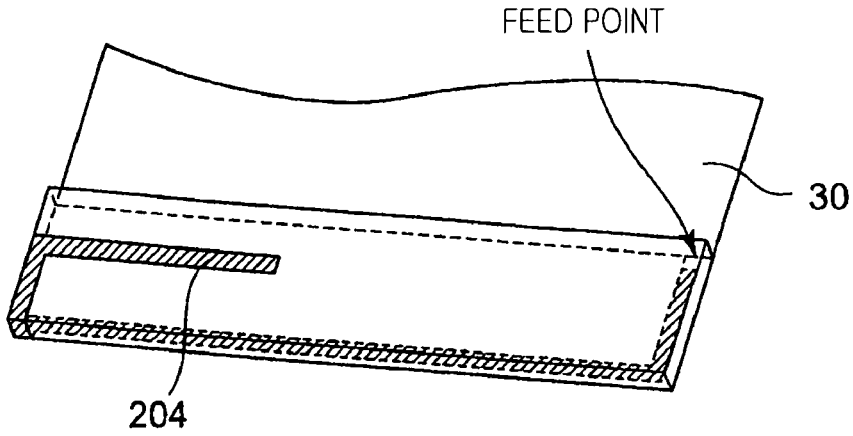
FIG. 3B is an enlarged view of the antenna section of FIG. 3A.
Figure 5A:
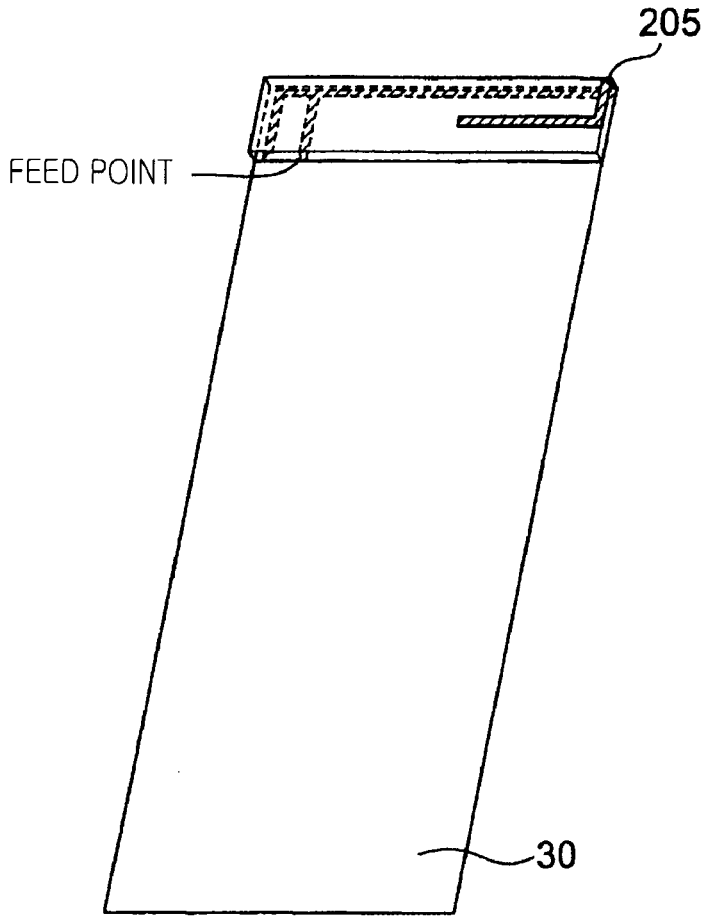
FIG. 5A illustrates a reverse F-shaped antenna apparatus using simulation of an electric performance according to embodiments of the present invention.
Figure 5B:
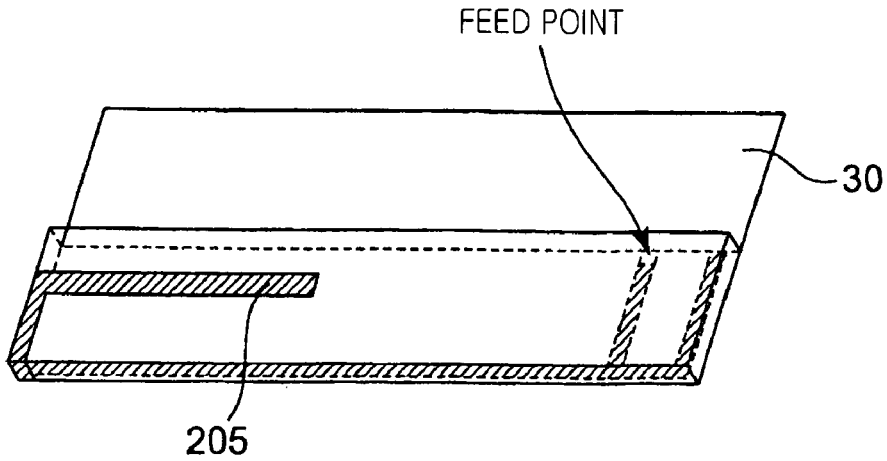
FIG. 5B is an enlarged view of the antenna section of FIG. 5A.

In the design of the antenna apparatus 10 that includes the above-described structure, the electric performance of the conventional third type antenna apparatus has been discussed with respect to voltage standing wave ratio (VSWR) and impedance. That is, VSWRs and impedances are simulated when a reverse L-shaped planar antenna 204 is installed at a relatively short end of the ground plate 30 that is dimensioned to be 100 mm by 45 mm as illustrated in FIGS. 3A and 3B and when a reverse F-shaped planar antenna 205 is mounted as illustrated in FIGS. 5A and 5B. FIGS. 3A and 5A illustrate the entire antenna apparatus, and FIGS. 3B and 5B illustrate enlarged view of the antenna units.

Here, the patterns of the antenna elements 204 and 205 are formed on surfaces of a dielectric resin, such as, acrylonitrile butadiene styrene (ABS), which is dimensioned to be 100 mm by 45 mm by 2 mm, by folding the tip ends of the antenna elements 204 and 205. The ABS has a relative permittivity ($\epsilon r$) of 3.5.

Figure 4:
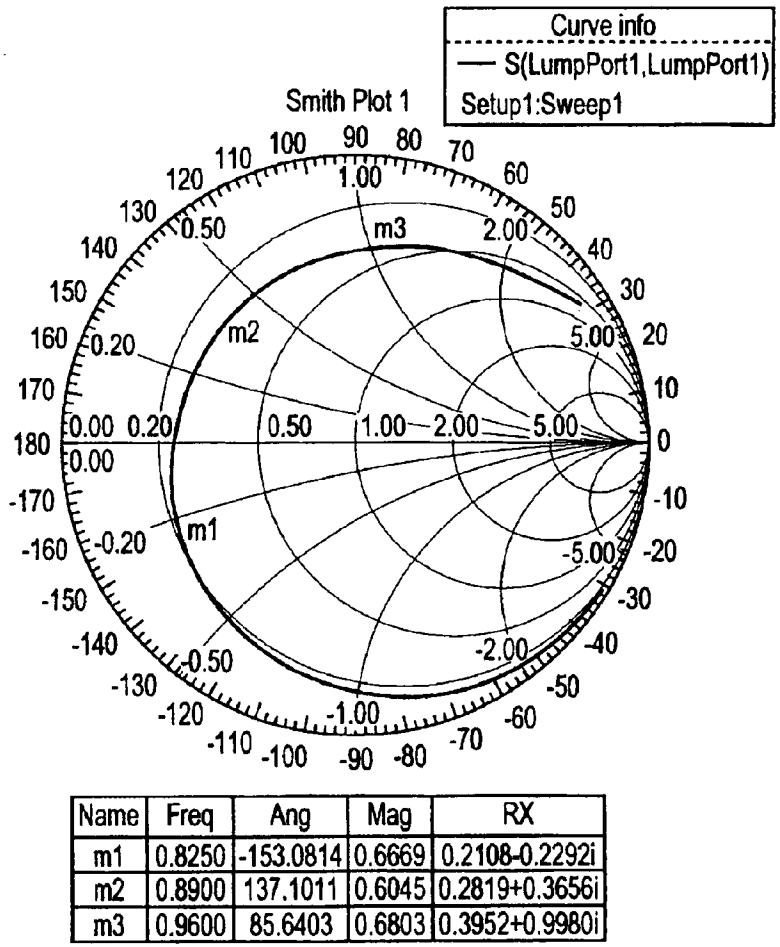
FIG. 4 illustrates a simulation result of the reverse L-shaped antenna apparatus of FIG. 3A.
Figure 4:
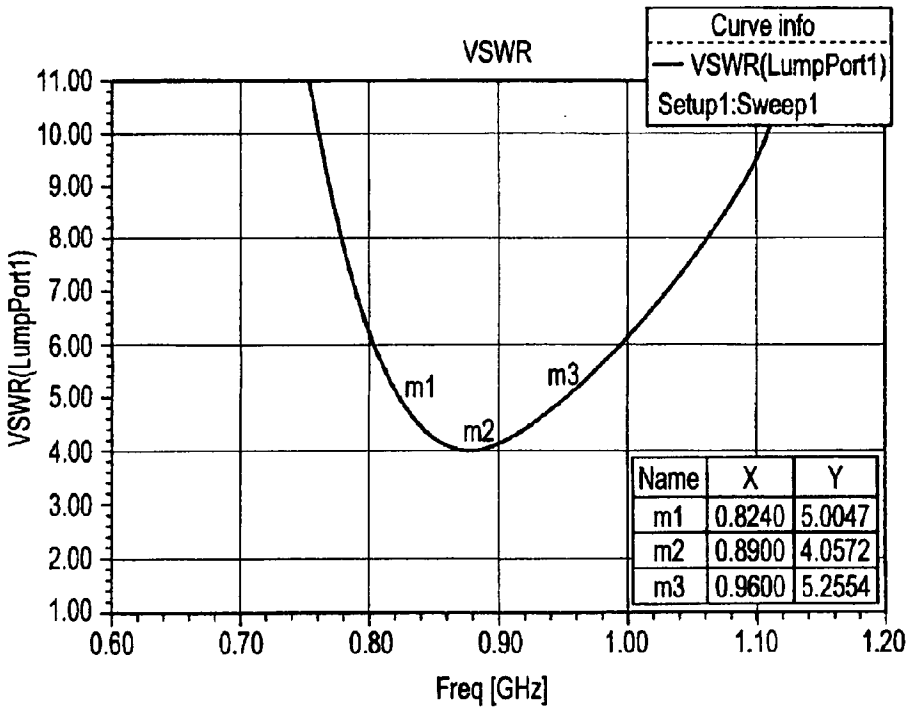

FIG. 4 illustrates a simulation result of the reverse L-shaped planar antenna 204 of FIG. 3. It can be seen from the result that the impedance and VSWR of the small-sized and low-profiled antenna deteriorates due to lowering of radiation resistance. The value of VSWR is about less than 5.5 in the designed frequency band and cannot be higher than that.

Figure 6:
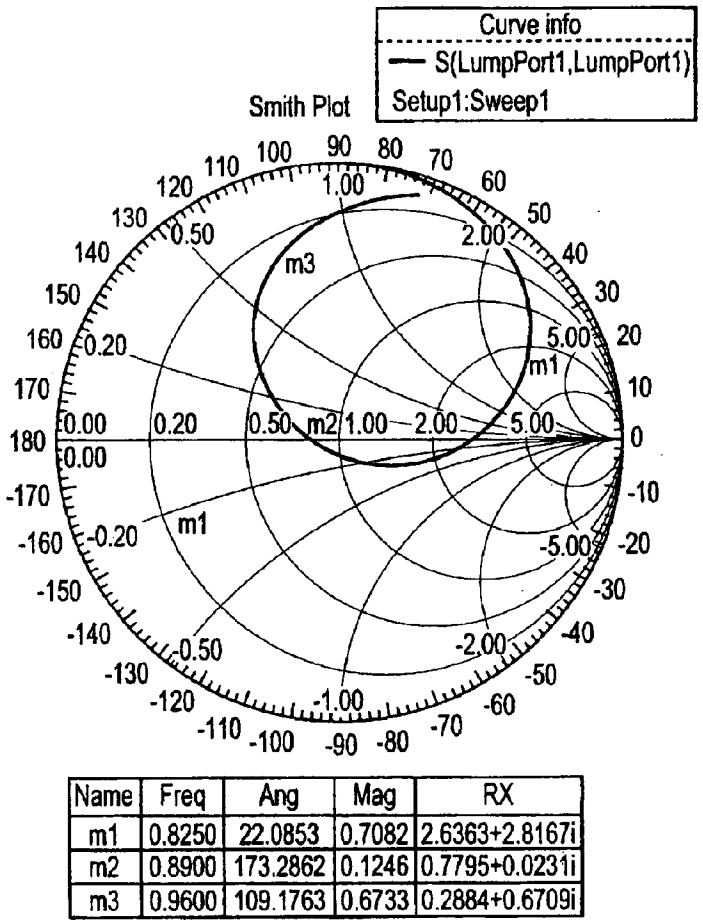
FIG. 6 illustrates a simulation result of the reverse F-shaped antenna apparatus of FIG. 5A.
Figure 6:
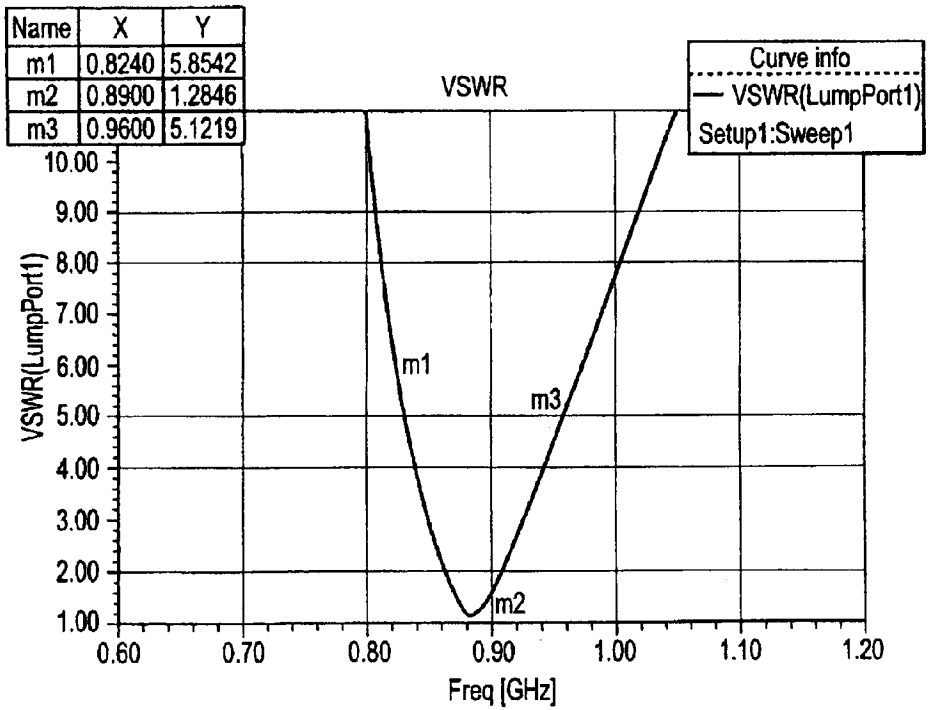

FIG. 6 illustrates a simulation result of the reverse F-shaped planar antenna of FIG. 5. It can be seen from the result that a good VSWR value can be obtained near the center frequency but the antenna has a narrow bandwidth. Generally, a reverse F-shaped antenna has a bandwidth narrower than that of a reverse L-shaped antenna, but, in the simulation result, has a further narrower bandwidth as the value of Q increases due to its small size.

In this way, when an antenna apparatus is made small-sized using a conventional reverse L-shaped antenna or reverse F-shaped antenna, there occurs a problem of deterioration of electric performance.

However, in order to make an antenna apparatus smaller, a need exists both to study its shape and to efficiently shorten waves by loading a material. Although the above-described reverse L-shaped antenna is designed such that the electric field (L) of the antenna using a ground plate is approximately $\lambda/4$, when the antenna apparatus is configured considering the wave shortening effect of relative permeability ($\mu r$) and relative permittivity ($\epsilon r$) due to loading of a magnetic body and a dielectric body, the relation equation of the length (L) of the antennal element may be expressed as Equation 1:

$$L=(\lambda/4)/\sqrt{(\epsilon r \cdot \mu r)}. \quad \text{[Eqn. 1]}$$

If the values of relative permeability ($\mu r$) and relative permittivity ($\epsilon r$) become larger, a strong wave shortening effect can be obtained. Meanwhile, as discussed above, a small-sized antenna apparatus is accompanied by deterioration of electric performance. In order to examine the material loading of the magnetic piece and the dielectric piece, as illustrated in FIGS. 7A and 7B and FIGS. 9A and 9B, a magnetic piece 40 or a dielectric piece 50 is disposed at a tip end or near the feed point of the antenna element 204 of the reverse L-shaped antenna apparatus to simulate VSWR and impedance.

Figure 7A:
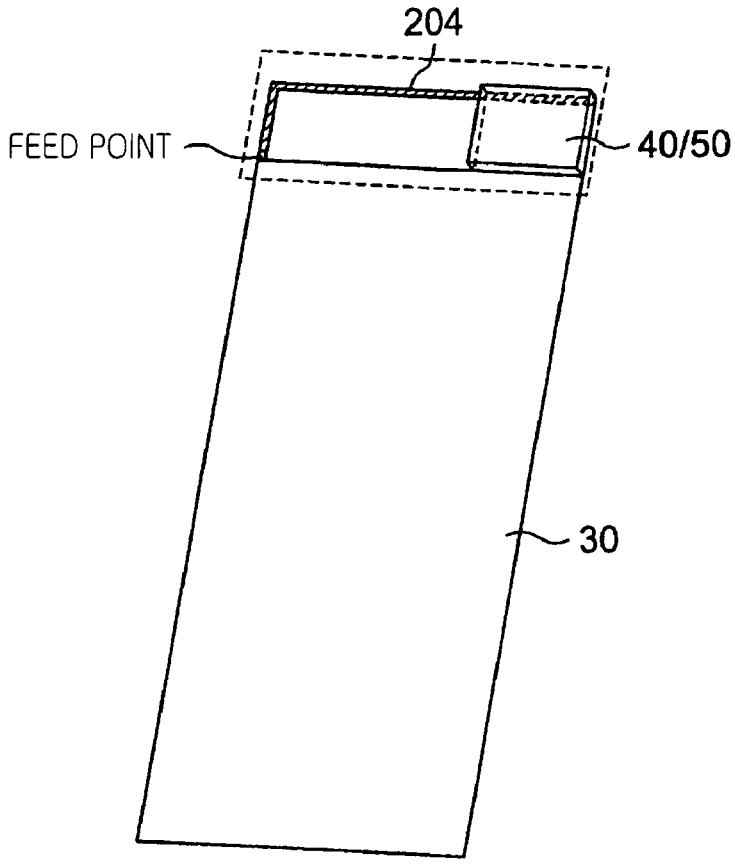
FIG. 7A illustrates a reverse L-shaped antenna apparatus using simulation of an electric performance when a magnetic piece/dielectric piece is loaded at an tip end of the antenna element according to embodiments of the present invention.
Figure 7B:
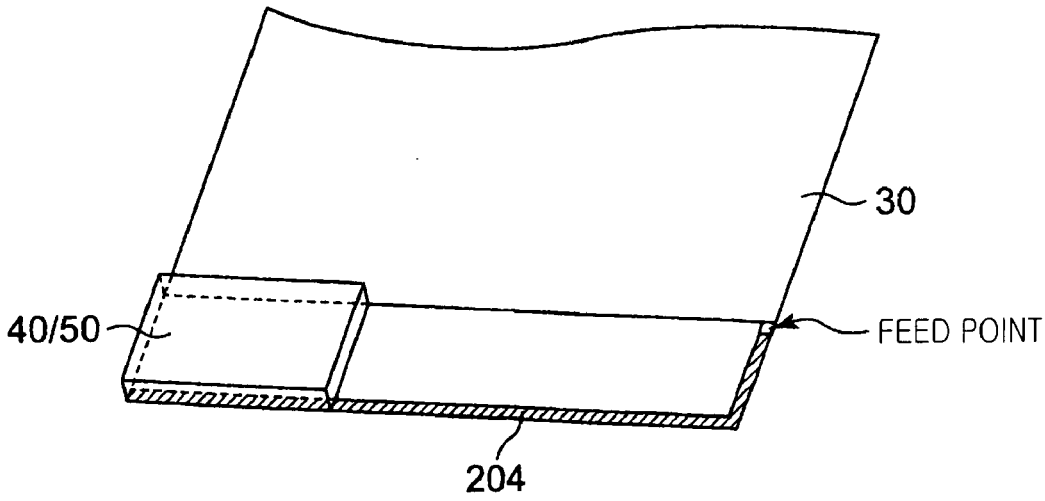
FIG. 7B is an enlarged view of the antenna section of FIG. 7A.
Figure 9A:
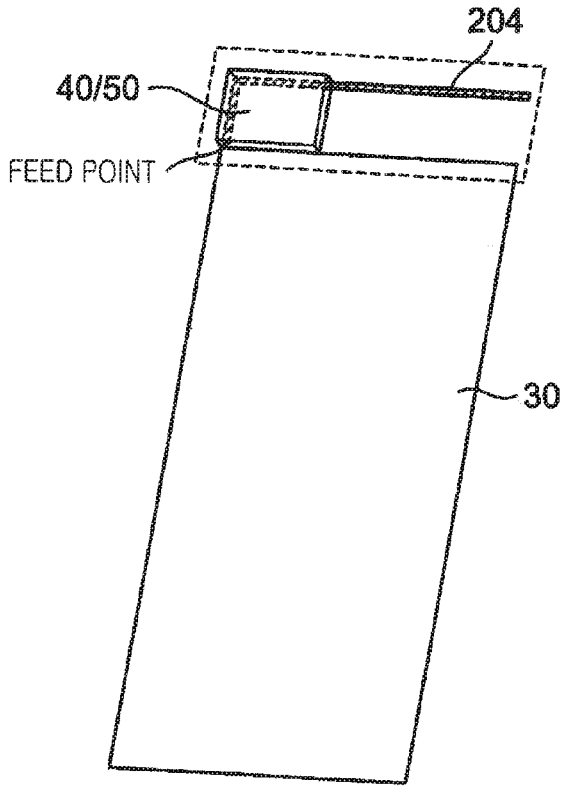
FIG. 9A illustrates a reverse L-shaped antenna apparatus using simulation of an electric performance when a magnetic piece/dielectric piece is loaded at a source portion of the antenna element according to embodiments of the present invention.
Figure 9B:
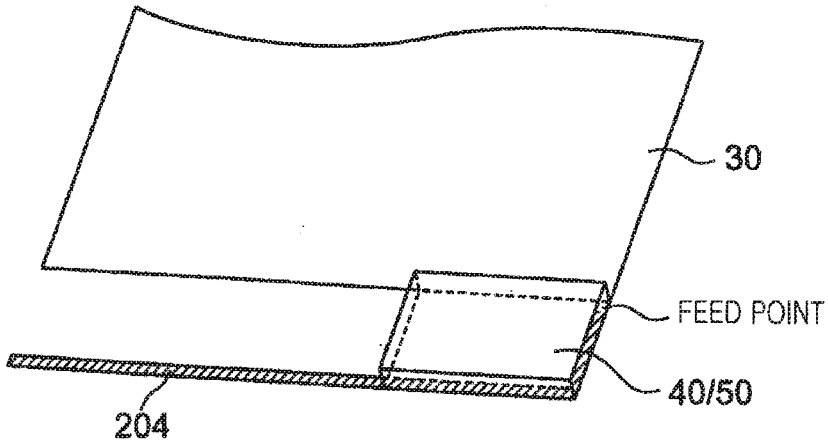
FIG. 9B is an enlarged view of the antenna section of FIG. 9A.

FIGS. 7A and 9A illustrate the entire antenna apparatus and FIGS. 7B and 9B illustrate enlarged antenna units surrounded by dotted lines. In this simulation, the magnetic piece 40 and the dielectric piece 50 are dimensioned to be 15 mm by 10 mm by 2 mm (0.3 cc) and the material constant is as follows:

Relative permeability ($\mu r$)=1, relative permittivity ($\epsilon r$) =variable within 1 to 80

Relative permittivity ($\epsilon r$)=1, relative permeability ($\mu r$).

Figure 8:
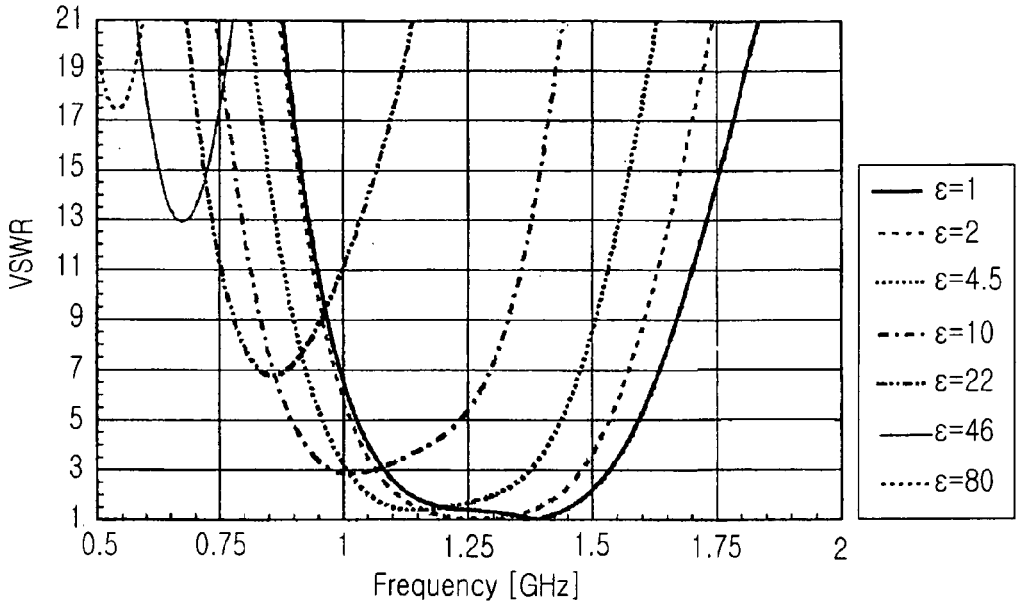
FIG. 8 illustrates a simulation result of the reverse L-shaped antenna apparatus of FIG. 7A.
Figure 8:
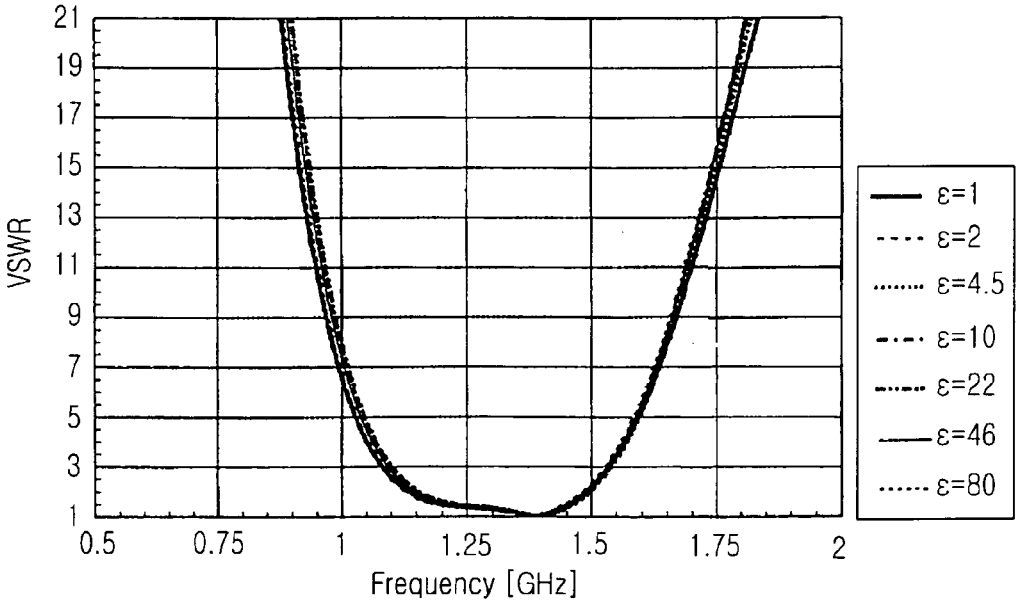

FIG. 8 illustrates a simulation result obtained when a magnetic piece 40 or a dielectric piece 50 is disposed at a tip end of the antenna element 204 as illustrated in FIGS. 7A and 7B. In FIG. 8, if relative permeability (μr) is fixed to '1' and relative permittivity (εr) is varied, the waveform of the frequency rapidly becomes lower as relative permittivity (εr) is set to be higher. That is, a wave shortening effect becomes stronger due to relative permittivity (εr).

Figure 10:
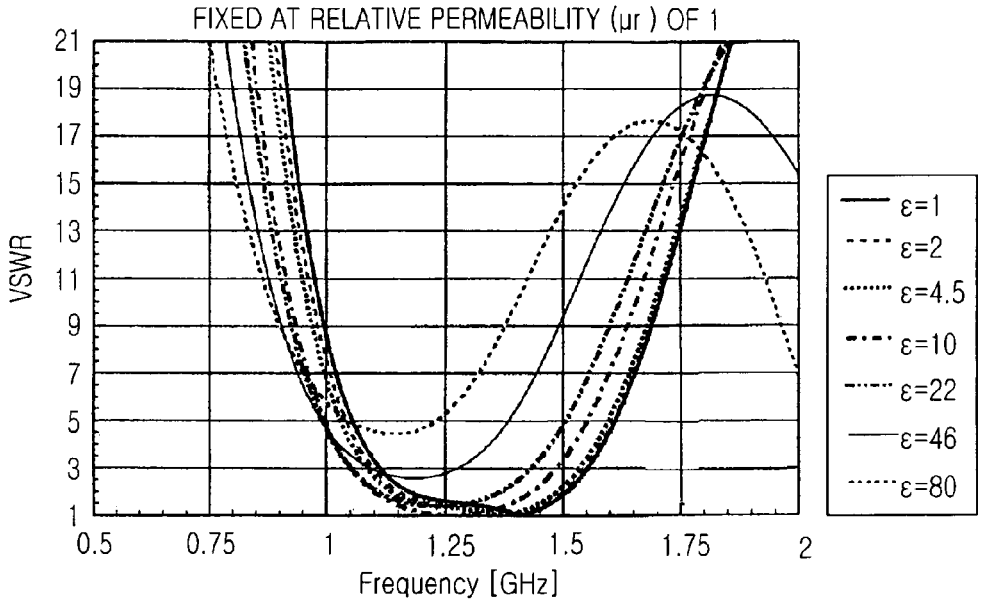
FIG. 10 illustrates a simulation result of the reverse L-shaped antenna apparatus of FIG. 9A.
Figure 10:
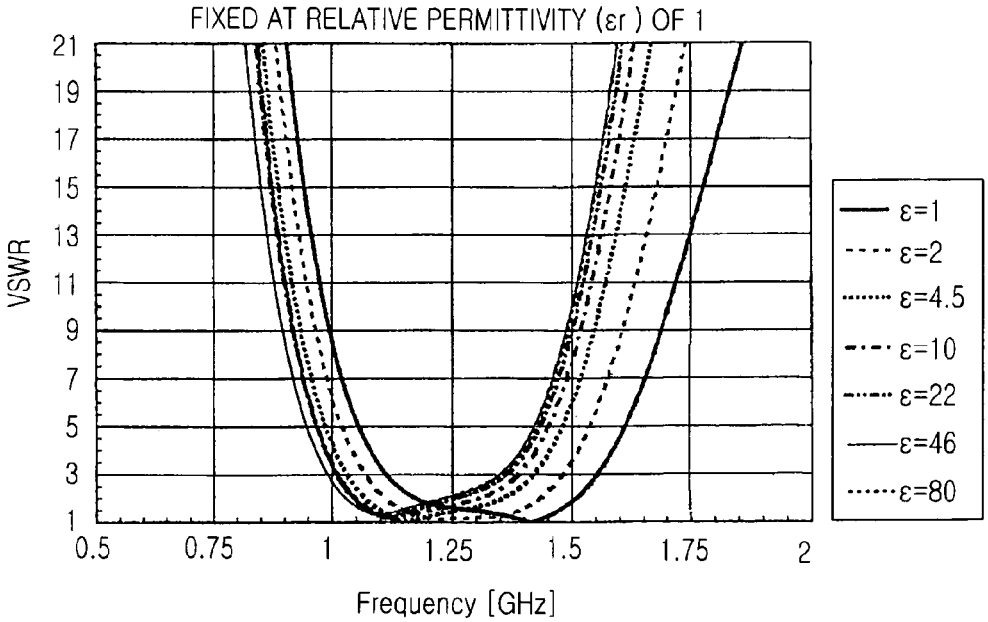

Meanwhile, FIG. 10 is a simulation result obtained when a magnetic piece 40 or a dielectric piece 50 is disposed at a tip end of the antenna element 204 as illustrated in FIGS. 7A and 7B. In FIG. 10, if relative permittivity (εr) is fixed to '1' and relative permeability (μr) is varied, the waveform of the frequency becomes lower as relative permeability (μr) is set to be higher. That is, a wave shortening effect becomes further stronger due to relative permeability (μr). That is, in spite of a lower change rate, it is difficult to deteriorate impedance and change VSWR or bandwidth.

Figure 11:
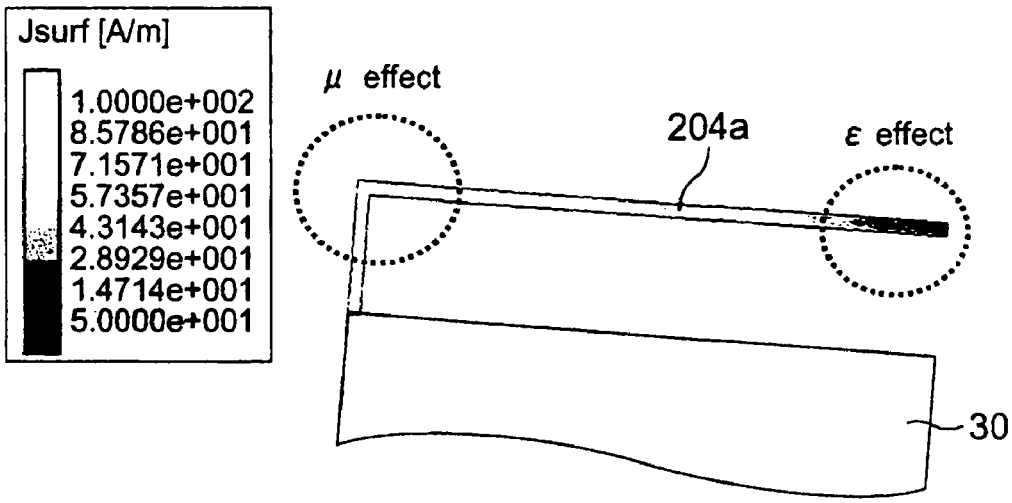
FIG. 11 illustrates distribution of currents in the antenna element of a reverse L-shaped antenna apparatus according to embodiments of the present invention.

In order to examine their operation principle, simulation analyses of distribution of currents on the surface of the antenna elements of the same type of reverse L-shaped antenna apparatus were performed. The result is illustrated in FIG. 11. A dense portion indicates low distribution of currents and a light portion indicates high distribution of currents. That is, it can be seen that distribution of currents is low at a tip end of the antenna element 204*a* and is high at a source portion near the feed point. The simulation results of FIGS. 8 and 10 show that loading of a dielectric body is effective at a portion where distribution of currents is low (that is, the electric field is high) and loading of a magnetic body is effective at a portion where distribution of currents is high.

Figure 12:
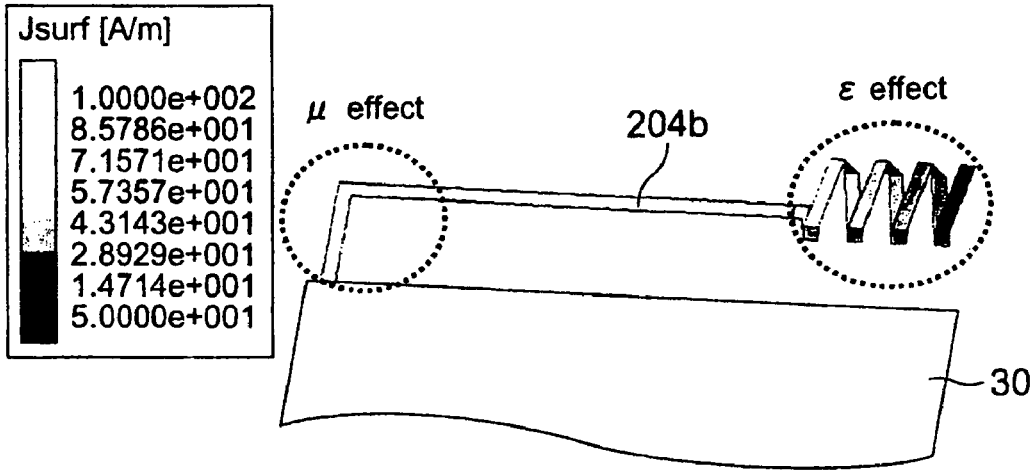
FIG. 12 illustrates distribution of currents in the antenna element of an antenna apparatus according to the present invention.

Next, as illustrated in FIG. 12, a simulation analysis of an antenna element 204*b* which is modified from a reverse L-shaped antenna of FIG. 11 was performed. In order to make a reverse L-shaped antenna small-sized and low-profile, a tip end of the antenna element 204*b* includes a helical shape and an inductance component is added to the tip end. In antenna element 204*b*, current distribution of the tip end is low and current distribution of a source portion near the feed point is high.

Based on the above-discussed results, in the antenna apparatus 10 of the present invention, illustrated in FIGS. 1A and 1B, a tip end of an antenna element 20 includes a planar helical shape formed on a surface of a ceramic piece 50 and a source portion near the feed point is formed on a surface of a ferrite piece 40.

Here, the ferrite piece 40 is dimensioned to be 8 mm by 5 mm by 2 mm (0.08 cc) and the material characteristics in which εr is '13,' tan δ is '0.01,' μr is '3,' and tan δ is '0.05' at the frequency of 1 GHz. The ceramic piece 50 is dimensioned to be 5 mm by 12 mm by 2 mm (0.12 cc) and the material characteristics in which εr is '60' and tan δ is '0.06' at the frequency of 1 GHz. However, the material characteristics and sizes of the elements may be designed depending on the frequency and bandwidth of an antenna.

Figure 13:
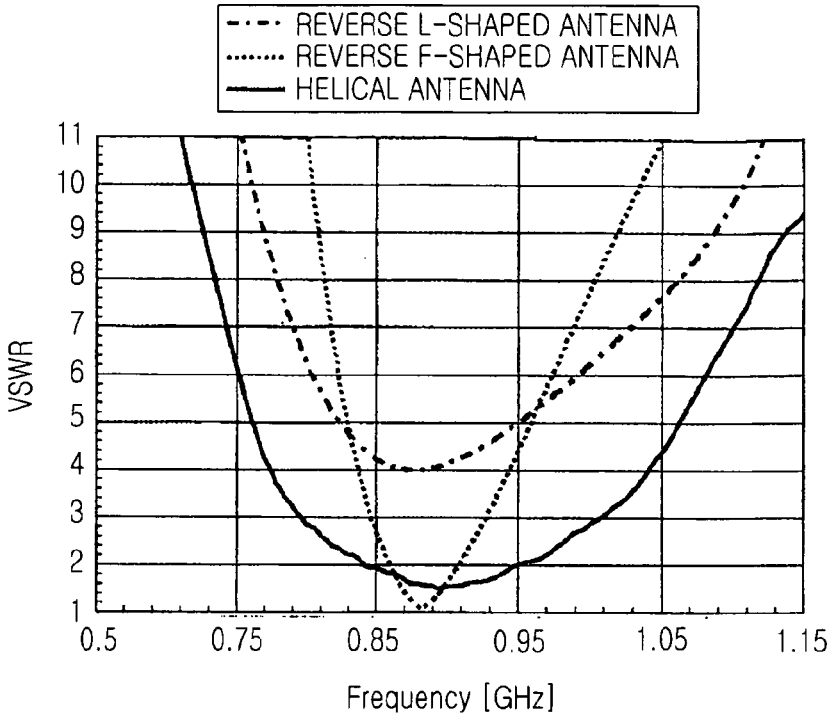
FIG. 13 illustrates an electric performance of an antenna apparatus according to the present invention.

FIG. 13 illustrates a value obtained by adding a VSWR performance of the antenna apparatus 10 to the VSWR performances of the reverse L-shaped antenna apparatus and the reverse F-shaped antenna of FIGS. 4 and 6. It can be seen from FIG. 13 that the antenna apparatus according to the present invention has a VSWR value that is improved by three as compared with the reverse L-shaped antenna. Additionally, for a frequency bandwidth in which the VSWR value is smaller than '3,' an improvement of fifteen percent (15%) can be obtained as compared with the reverse F-shaped antenna apparatus.

Until now, an embodiment of the present invention has been described. Although an antenna is used in a portable terminal and an optimum value is obtained at 800 MHz, it is exemplary and the present invention can be variously carried out in addition.

According to the present invention, a small-sized and low-profiled built-in antenna for a portable terminal has an excellent performance satisfying a frequency band of GSM 850/950 (824 to 960 MHz).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A built-in antenna apparatus for a portable terminal, the antenna apparatus comprising:

a ground plate comprising a feed point; and an antenna unit disposed adjacent to an end of the ground plate and including a reverse L-shaped antenna element wherein a first end of the L-shaped antenna element is coupled to the feed point and a second end of the L-shaped antenna element comprises a helical shape, and wherein a magnetic piece is loaded at the first end and a dielectric piece is loaded at the second end.

2. The antenna apparatus as claimed in claim 1, wherein the helical shape of the antenna element is formed by the second end of the L-shaped antenna element on a surface of the dielectric piece.

3. The antenna apparatus as claimed in claim 1, wherein a long edge of the reverse L-shape of the antenna element is parallel to an end of the ground plate.

4. The antenna apparatus as claimed in claim 3, wherein an impedance is adjusted by varying the distance between the long edge of the reverse L-shape of the antenna element and the end of the ground plate.

5. The antenna apparatus as claimed in claim 1, wherein the first end comprises a portion where current distribution of the L-shaped antenna element is high, and the second end comprises a portion where current distribution of the L-shaped antenna element is low.

6. The antenna apparatus as claimed in claim 1, wherein the magnetic piece is dimensioned to be 8 mm×5 mm×2 mm.

7. The antenna apparatus as claimed in claim 1, wherein the dielectric piece is dimensioned to be 5 mm×12 mm×2 mm.

8. A portable terminal for use in a wireless communication system, the mobile station comprising:

a built-in antenna apparatus, the built in antenna apparatus comprising:

a ground plate comprising a feed point; and an antenna unit disposed adjacent to an end of the ground plate and including a reverse L-shaped antenna element wherein a first end of the L-shaped antenna element is coupled to the feed point and a second end of the L-shaped antenna element comprises a helical shape, and wherein a magnetic piece is loaded at the first end and a dielectric piece is loaded at the second end.

9. The portable terminal as claimed in claim 8, wherein the helical shape of the antenna element is formed by the second end of the L-shaped antenna element on a surface of the dielectric piece.

10. The portable terminal as claimed in claim 8, wherein a long edge of the reverse L-shape of the antenna element is parallel to an end of the ground plate.

11. The portable terminal as claimed in claim 10, wherein an impedance is adjusted by varying the distance between the long edge of the reverse L-shape of the antenna element and the end of the ground plate.

12. The portable terminal as claimed in claim 8, wherein the first end comprises a portion where current distribution of the L-shaped antenna element is high, and the second end comprises a portion where current distribution of the L-shaped antenna element is low.

13. The portable terminal as claimed in claim 8, wherein the magnetic piece is dimensioned to be 8 mm×5 mm×2 mm.

14. The portable terminal as claimed in claim 8, wherein the dielectric piece is dimensioned to be 5 mm×12 mm×2 mm.

15. A method for use in a portable terminal capable of communicating in a wireless communication system, the method comprising:

receiving communications via a built-in antenna apparatus, the built in antenna apparatus comprising:

a ground plate comprising a feed point; and an antenna unit disposed adjacent to an end of the ground plate and including a reverse L-shaped antenna element wherein a first end of the L-shaped antenna element is coupled to the feed point and a second end of the L-shaped antenna element comprises a helical shape, and wherein a magnetic piece is loaded at the first end and a dielectric piece is loaded at the second end; and transmitting communications via the built in antenna apparatus.

16. The method as claimed in claim 15, wherein the helical shape of the antenna element is formed by the second end of the L-shaped antenna element on a surface of the dielectric piece.

17. The method as claimed in claim 15, wherein a long edge of the reverse L-shape of the antenna element is parallel to an end of the ground plate.

18. The method as claimed in claim 17, wherein an impedance is adjusted by varying the distance between the long edge of the reverse L-shape of the antenna element and the end of the ground plate.

19. The method as claimed in claim 15, wherein the first end comprises a portion where current distribution of the L-shaped antenna element is high, and the second end comprises a portion where current distribution of the L-shaped antenna element is low.

20. The method as claimed in claim 15, wherein the magnetic piece is dimensioned to be 8 mm×5 mm×2 mm and wherein the dielectric piece is dimensioned to be 5 mm×12 mm×2 mm.

* * * * *